US009732468B2

(12) United States Patent
Devero et al.

(10) Patent No.: US 9,732,468 B2
(45) Date of Patent: Aug. 15, 2017

(54) SPLICED ROPE APPARATUS AND METHOD

(71) Applicant: Actuant Corporation, Menomonee Falls, WI (US)

(72) Inventors: Neathan Devero, Mt. Vernon, WA (US); Randy Longerich, Bellingham, WA (US)

(73) Assignee: Actuant Corporation, Menomonee Falls, WI (US)

( * ) Notice: Subject to any disclaimer, the term of this patent is extended or adjusted under 35 U.S.C. 154(b) by 394 days.

(21) Appl. No.: 14/382,468

(22) PCT Filed: Feb. 28, 2013

(86) PCT No.: PCT/US2013/028181

§ 371 (c)(1),
(2) Date: Sep. 2, 2014

(87) PCT Pub. No.: WO2013/134033

PCT Pub. Date: Sep. 12, 2013

(65) Prior Publication Data

US 2015/0128553 A1 May 14, 2015

Related U.S. Application Data

(60) Provisional application No. 61/606,670, filed on Mar. 5, 2012.

(51) Int. Cl.

| | |
|---|---|
| ***D07B 7/16*** | (2006.01) |
| ***B65H 69/06*** | (2006.01) |
| *D07B 7/18* | (2006.01) |

(52) U.S. Cl.

CPC ..... *D07B 7/167* (2013.01); *B65H 69/06* (2013.01); *D07B 7/169* (2015.07); *D07B 7/18* (2013.01);

(Continued)

(58) Field of Classification Search

CPC ..... D07B 7/167; D07B 7/169; D07B 7/18; D07B 2201/1014; D07B 2201/1096; B65H 69/06

(Continued)

(56) References Cited

U.S. PATENT DOCUMENTS 345,719 A * 7/1886 Nash ..... D07B 7/169 57/22
411,637 A * 9/1889 Batchelor ..... D07B 7/169 140/111

(Continued)

FOREIGN PATENT DOCUMENTS

DE 941050 3/1956

OTHER PUBLICATIONS

EP137576781 Extended European Search Report dated Jan. 19, 2016 (9 pages).

(Continued)

*Primary Examiner* — Shaun R Hurley
*Assistant Examiner* — Bao-Thieu L Nguyen
(74) *Attorney, Agent, or Firm* — Michael Best & Friedrich LLP

(57) ABSTRACT

A spliced rope apparatus and a method of forming the same are disclosed. The apparatus has a first rope including a first plurality of strands and a second rope including a second plurality of strands. The apparatus also has a splice connecting the ropes and defined by the first and second pluralities of strands. The splice has a spiral section including a first pair having strands of the first plurality of strands that are positioned proximate each other. The first pair extends helically and the strands of the first pair together pass under a plurality of picks defined by the second plurality of strands and together pass over a remainder of the second plurality of strands. The splice also has a tuck section (Continued)

in which at least some of the first plurality of strands extend longitudinally to pass under and over sequential picks defined by the second plurality of strands.

20 Claims, 17 Drawing Sheets

(52) U.S. Cl.
CPC ..... *D07B 2201/1014* (2015.07); *D07B 2201/1096* (2013.01)

(58) Field of Classification Search
USPC ..... 57/200, 202, 204, 23
See application file for complete search history.

(56) References Cited

U.S. PATENT DOCUMENTS

| | | | | | |
|---|---|---|---|---|---|
| 460,407 | A * | 9/1891 | Thompson | D07B 7/169 | 57/22 |
| 1,283,044 | A * | 10/1918 | Beasley | D07B 7/18 | 57/23 |
| 2,482,204 | A * | 9/1949 | Peterson | B65H 69/06 | 57/202 |
| 2,645,840 | A * | 7/1953 | Leary | A01F 15/145 | 289/1.2 |
| 3,356,397 | A | 12/1967 | Bagby | | |
| 3,903,680 | A * | 9/1975 | Isern | B65H 69/06 | 57/22 |
| 4,191,009 | A * | 3/1980 | Thomson | D07B 7/169 | 57/202 |
| 6,422,118 | B1 * | 7/2002 | Edwards | B65H 69/06 | 28/141 |
| 2015/0167782 | A1 * | 6/2015 | Drake | B65H 69/06 | 57/22 |
| 2016/0168787 | A1 * | 6/2016 | Downs | D07B 1/185 | 57/202 |

OTHER PUBLICATIONS

Samson, "Splicing Instructions," instruction brochure, Mar. 21, 2006 (104 pages).

PCT/US2013/028181 International Preliminary Report on Patentability and Written Opinion of the International Searching Authority, date mailed Sep. 18, 2014 (8 pages).

End-for-End Tuck Splice instructions. Manual (online). New England Ropes Corporation (NROPES). Nov. 10, 2011. [retrieved on May 27, 2013]. Retrieved from the internet: <URL: http://www.neropes.com/Splicing Guide Individual Splices/End_For_End_Tuck_Splice.pdf>.

International Search Report for Application No. PCT/US2013/028181 dated Jun. 13, 2013 (1 page).

First Office Action from the Australian Intellectual Property Office for Application No. 2013230564 dated Jun. 10, 2016 (3 pages).

* cited by examiner 16
1L
2L
3L
4L
5L
6L
1L
2L
1R
2R
3R
4R
5R
6R
1R
2R
3R
4R
5R
6R
1L
2L
3L
4L
5L
6L
1R
2R
1L
2L
3L
4L
5L
6L
1R
2R
1L
2L
3L
4L
5L
6L
1R
2

SPLICED ROPE APPARATUS AND METHOD

TECHNICAL FIELD

This invention relates to a spliced rope apparatus and a method for splicing ropes, and more particularly, a relatively long spliced rope apparatus and a method for splicing relatively-long ropes that pass over sheaves.

BACKGROUND ART

In recent years, braided synthetic ropes have replaced steel cables in many applications due to their relatively low weight, high strength, flexibility, resistance to corrosion, and electrically insulating properties. These applications include, among others, terrestrial applications such as tower staying, vehicle winching, and rigging, and marine and offshore applications such as deepwater mooring, deepwater lifting, oceanographic lifting and coring, seismic towing, salvaging, vessel towing, and commercial fishing.

Like many load-transmitting components, wear limits the useful life of synthetic ropes, and relatively long ropes (for example, ropes having lengths of a few hundred meters to several kilometers) can be extremely expensive to replace. In some cases, one or more sections of the rope wear out more quickly and reach the end of their life before other sections. To avoid the expense of replacing the entire rope in these cases, a relatively high-wear section can be removed and the remaining two sections joined back together. That is, the strands of the two remaining rope sections are interwoven to provide a physical connection between the two sections. However, ropes that pass over sheaves (for example, in deepwater lifting applications) are not typically spliced in the above manner because they tend to work loose from each other. As such, the entire rope may be replaced even if it includes several sections with relatively little wear.

As such, a need exists for a spliced rope apparatus and method for splicing ropes that address the above drawbacks.

DISCLOSURE OF INVENTION

In one aspect, the present invention provides a spliced rope apparatus having a first rope including a first plurality of strands and a second rope including a second plurality of strands. The apparatus also has a splice connecting the first and second ropes and defined by the first and second pluralities of strands. The splice has a spiral section including a first pair having strands of the first plurality of strands that are positioned proximate each other. The first pair extends helically and the strands of the first pair together pass under a plurality of picks defined by the second plurality of strands and together pass over a remainder of the second plurality of strands. The splice also has a tuck section in which at least some of the first plurality of strands extend longitudinally to pass under and over sequential picks defined by the second plurality of strands.

In another aspect, the present invention provides a method of splicing a first rope including a first plurality of strands to a second rope including a second plurality of strands. The method includes the step of forming a spiral splice section by helically extending a first pair of strands of the first plurality of strands around the second rope, passing the strands of the first pair together under a plurality of picks defined by the second plurality of strands, and passing the strands of the first pair together over a remainder of the second plurality of strands. The method further includes the step of forming a tuck splice section by alternatingly and longitudinally passing at least some of the first plurality of strands under and over sequential picks defined by the second plurality of strands.

The foregoing and other aspects of the invention will appear in the detailed description which follows. In the description, reference is made to the accompanying drawings which illustrate a preferred embodiment of the invention.

BEST MODE FOR CARRYING OUT THE INVENTION

Figure 1:
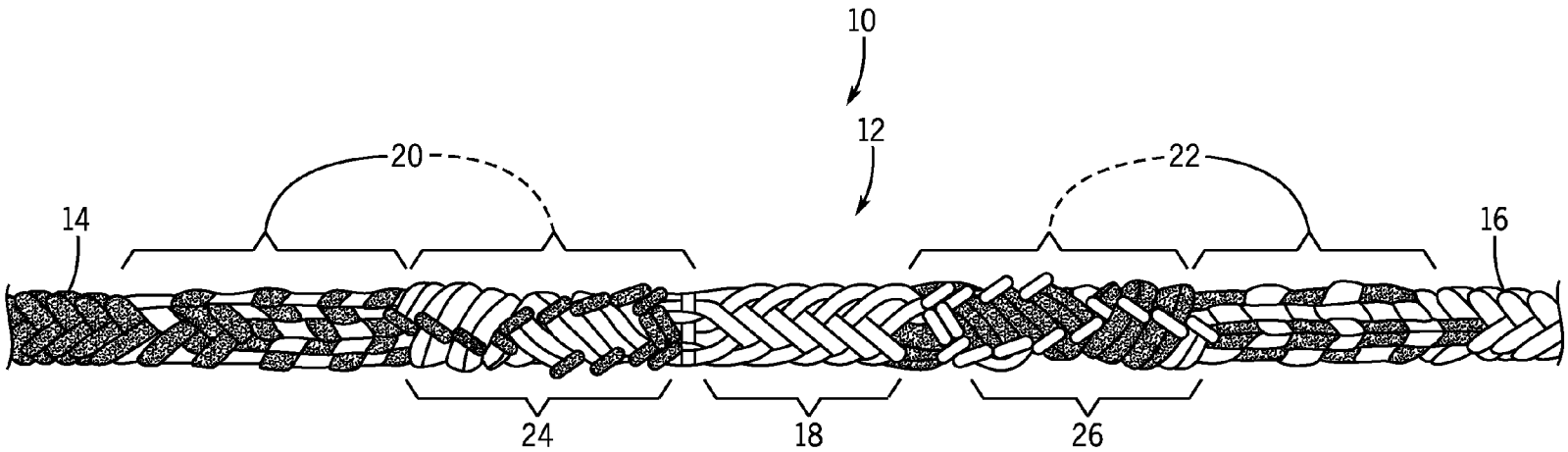
FIG. 1 is a partial side view of a spliced rope apparatus according to the present invention.

Referring to the figures and particularly FIG. 1, the present invention provides a spliced rope apparatus 10 in which a splice 12 connects and is defined by a first rope 14 (or a black rope as shown in the figures) and a second rope 16 (or a white rope as shown in the figures). The splice 12 includes various sections in which strands of the ropes 12 and 14 interweave with each other in different patterns. These sections include a moran section 18, first and second tuck sections 20 and 22, and first and second spiral sections 24 and 26. The different weave patterns in these sections advantageously inhibit the splice 12 from working loose, for example, if the spliced rope apparatus 10 repeatedly passes over a sheave.

In the following paragraphs, the structure of the spliced rope apparatus 10 will be described in further detail together with a method in which the apparatus 10 may be made. First, however, the initial structure of the black and white ropes 14 and 16 will be described in further detail.

Figure 2:
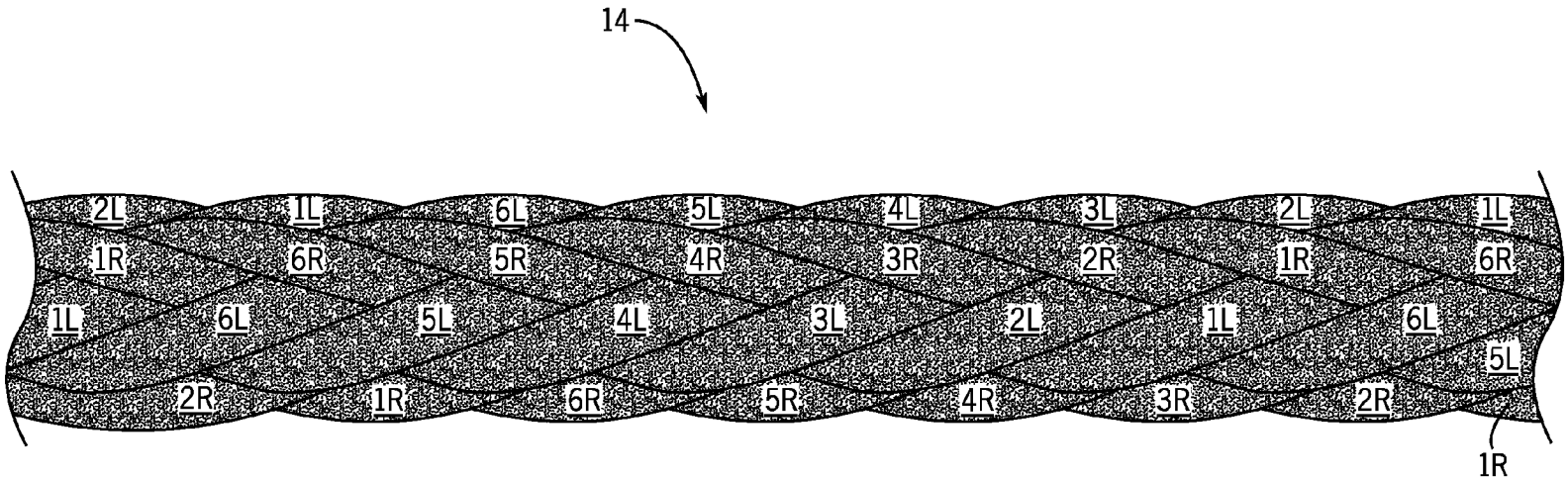
FIG. 2 is a partial side view of a first rope of the spliced rope apparatus.
Figure 3:
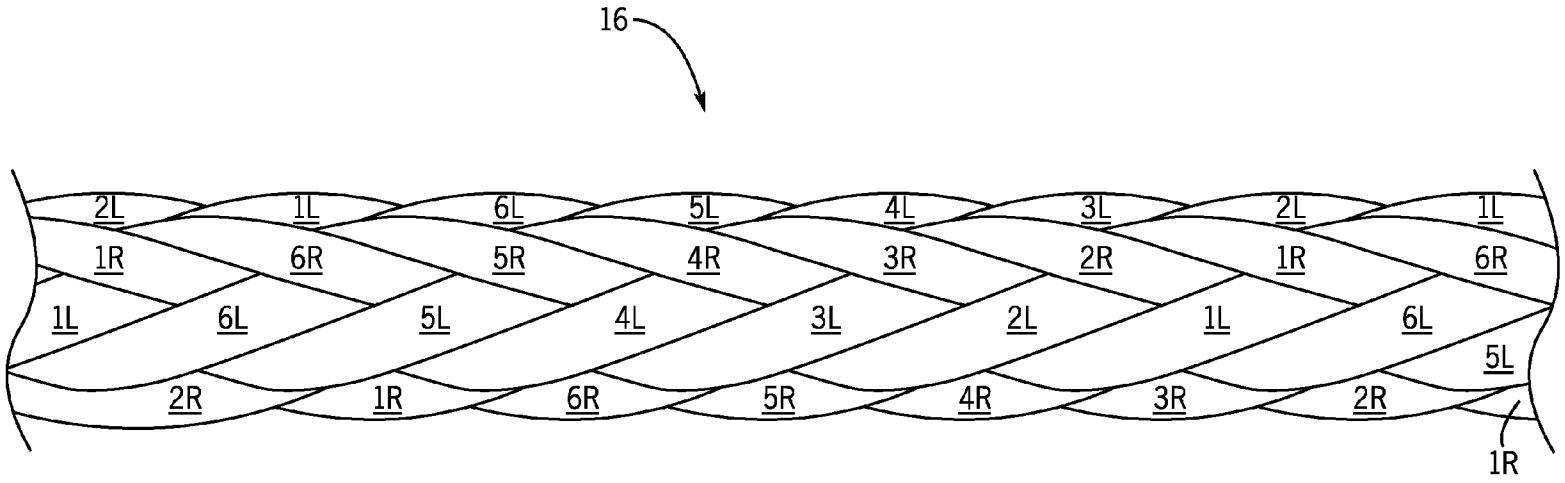
FIG. 3 is a partial side view of a second rope of the spliced rope apparatus.

Turning now to FIGS. 2 and 3, the black and white ropes 14 and 16 each initially include a plurality of braided strands that form a repeating pattern (the ropes 14 and 16 also form the repeating pattern longitudinally to the sides of the splice 10 after the splice 10 is formed). The strands themselves may each include a plurality of strands that form a repeating pattern, and those strands may in turn each include a plurality of synthetic fibers that may be combined by twisting or other means. For example, the black and white ropes 14 and 16 may each be a "12×12" rope available from Cortland Cable of Cortland, NY. That is, each rope may include high modulus and high strength fibers such as Spectra® fibers, Plasma® enhanced Spectra® fibers, BOB® fibers, Technora® fibers, and Vectran® fibers. Furthermore, each rope may be a twelve-strand single braided rope in which each of the twelve strands in turn includes a twelve-strand rope, or braided primary strand. Each rope may have a polyurethane finish, although other coatings may alternatively be used.

Of the twelve strands in such ropes, six strands extend helically or spiral in a right-handed direction (that is, six strands extend in a clockwise direction around the other strands when viewing the strands from one end and moving longitudinally away from the end) and the other six strands extend helically or spiral in a left-handed direction (that is, six strands extend in a counter-clockwise direction around the other strands when viewing the strands from one end and moving longitudinally away from the end).

Furthermore, each strand forms a repeating pattern of passing over (that is, radially outwardly if the rope is considered to have a general cylindrical shape) two strands extending in the opposite direction (referred to herein as "opposite strands" for simplicity), then passing under (that is, radially inwardly of) two opposite strands, then passing over two opposite strands, then passing under two opposite strands, then passing over two opposite strands, and then passing under two opposite strands. If the six right-handed strands are sequentially represented as nR for n=1 to 6 (that is, 1R, 2R, 3R, 4R, 5R, and 6R) and the six left-handed strands are sequentially represented as nL for n=1 to 6 (that is, 1L, 2L, 3L, 4L, 5L, and 6L), the following weave pattern can be established:

Strand nR passes over strands nL and (n+1)L, then under strands (n+2)L and (n+3)L, then over strands (n+4)L and (n+5)L, then under strands nL and (n+1)L, then over strands (n+2)L and (n+3)L, and then under strands (n+4)L and (n+5)L.

For this and the following generalized weave patterns, if the number preceding "L" or "R" exceeds six, six is subtracted from the number, or if the number preceding "L" or "R" is non-positive, six is added to the number. Other conventions may be used to describe the weave pattern; for example, a convention may be used in which strand 1R first passes under an opposite strand identified as strand 6L. However, the above convention will be used through the remainder of the disclosure.

At each location where a strand passes over strands spiraling in the opposite direction, the strand can be described as defining a pick. As used herein, the term "pick" refers to a section of a strand that passes over another strand or multiple sequential strands to define, in part, the outermost radial surface of the rope at that longitudinal location of the rope. FIGS. 2 and 3 essentially show a plurality of strand picks that obscure other portions of the strands. From the above, it should also be apparent that the term "sequential" refers to directly neighboring picks or strands that extend in the same direction. For example, strands 1R, 2R, 3R, 4R, 5R, and 6R of the first rope 14 form set of sequential strands.

Figure 4:
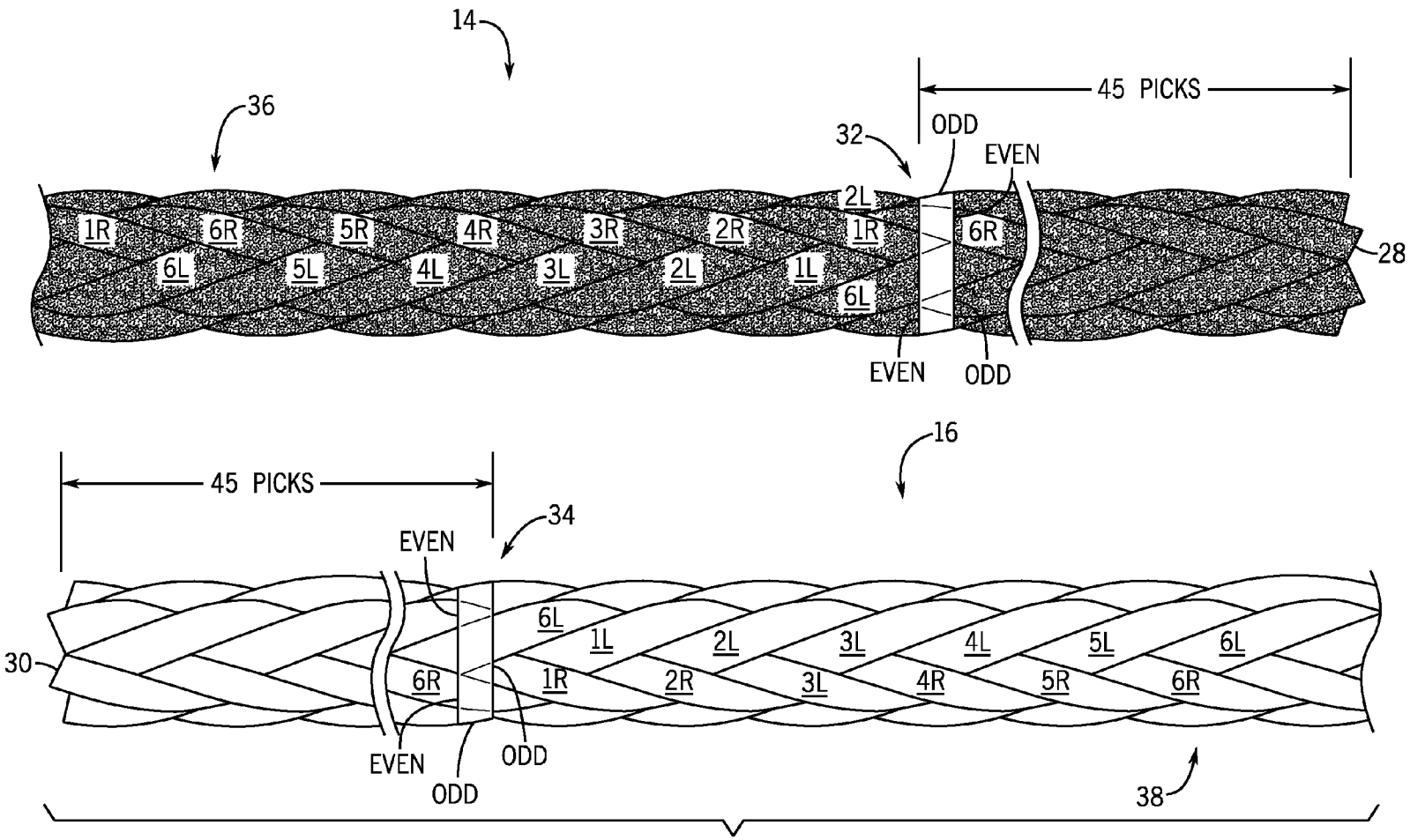
FIG. 4 is a partial side view of a step for forming the spliced rope apparatus in which the first and second ropes are positioned to face each other and pairs of strands in each rope are taped together.

A method for forming the spliced rope apparatus 10 will now be described in further detail. Referring to FIG. 4, the method begins by positioning the ropes 14 and 16 such that free ends 28 and 30 face generally opposite longitudinal directions. Then, taping locations 32 and 34 disposed forty-five picks apart from the free ends 28 and 30 are identified and may be indicated, for example, by a colored ink. At each of the taping locations 32 and 34, one of the right-handed strands is identified as strand 1R. The other right-handed strands, nR for n=2 to 6, are identified sequentially and proceeding away from the free ends 28 and 30. This in turn identifies the left-handed strands, nL for n=1 to 6, according to the above convention and as shown in the figures.

Next, pairs of right-handed strands and left-handed strands are taped together at the taping locations 32 and 34. "Odd" pairs are identified as pairs including strands nR and (7−n)L for n=1, 3, and 5 (for example, strands 1R and 6L form an odd pair), and "even" pairs are identified as pairs including strands (7−n)R and nL for n=1, 3, and 5 (for example, strands 4R and 3L form an even pair). As shown in the figures, the odd and even pairs alternate proceeding around the circumference of the ropes 14 and 16 at the taping locations 32 and 34.

Exit locations 36 and 38 disposed six picks apart from the taping locations 32 and 34 and opposite the free ends 28 and 30 (that is, past strands 6R) are then identified and may be indicated, for example, by another colored ink. The exit locations 36 and 38 are not used immediately, but instead after the following two steps.

Figure 5:
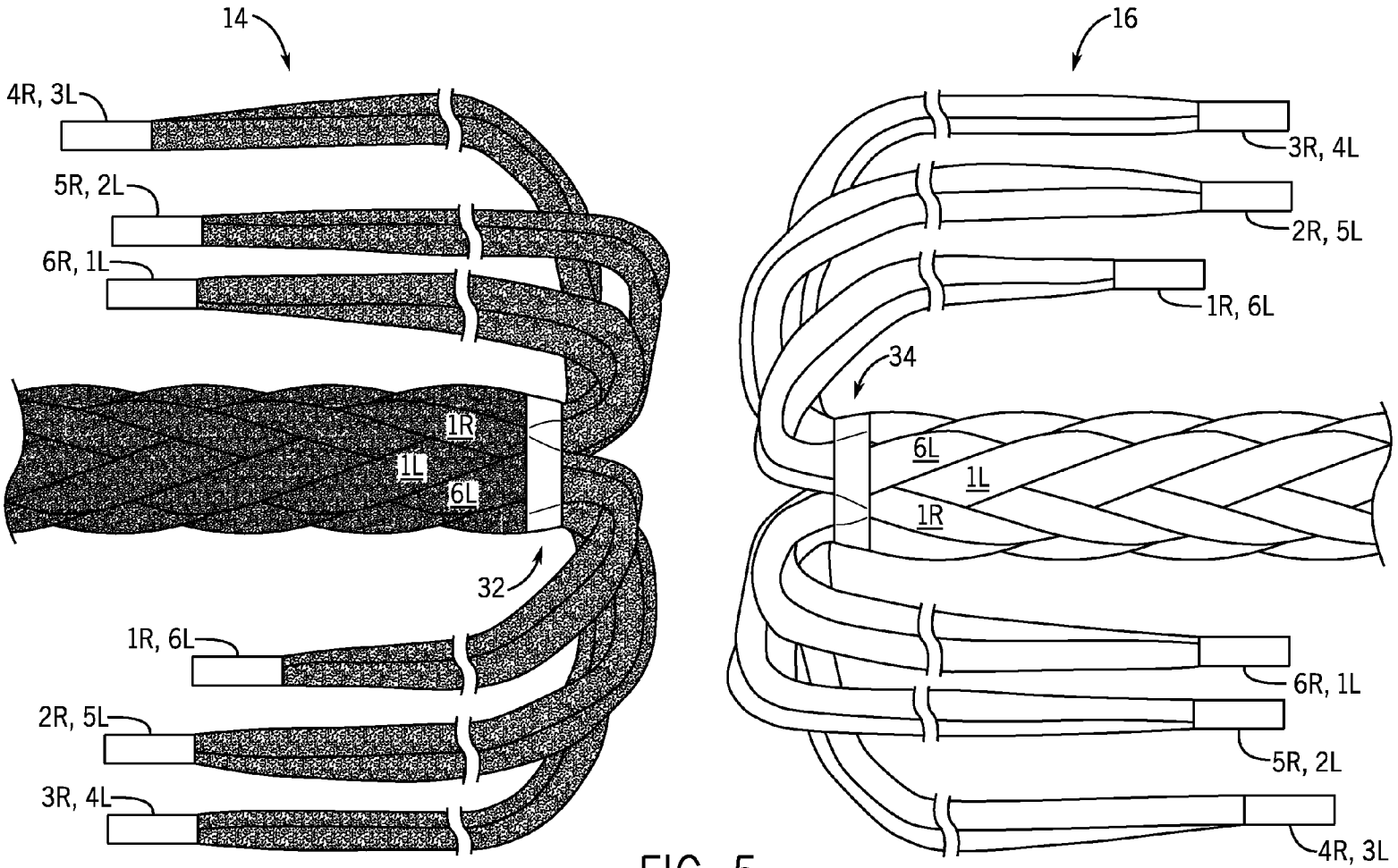
FIG. 5 is a partial side view of a step for forming the spliced rope apparatus in which the strand pairs are unbraided from free ends and taped together.

Turning to FIG. 5, the ropes 14 and 16 are then unwoven from the free ends 28 and 30 to the taping locations 32 and 34, and the unwoven strands are positioned extending away from those of the opposite rope 14 or 16. Next, the free ends of the strands for each rope 14 and 16 are taped together in the same manner as at the taping locations 32 and 34. That is, strands nR and (7−n)L for n=1, 3, and 5, or "odd" pairs, are taped together and strands (7−n)R and nL for n=1, 3, and 5, or "even" pairs, are taped together for each rope 14 and 16. The strands within each pair are considered to be disposed "proximate" each other. That is, within each pair one strand is disposed directly to the side of the other strand such that no other strands are disposed therebetween, unless the pair's strands "alternatingly" weave with other strands as described in further detail below.

Figure 6:
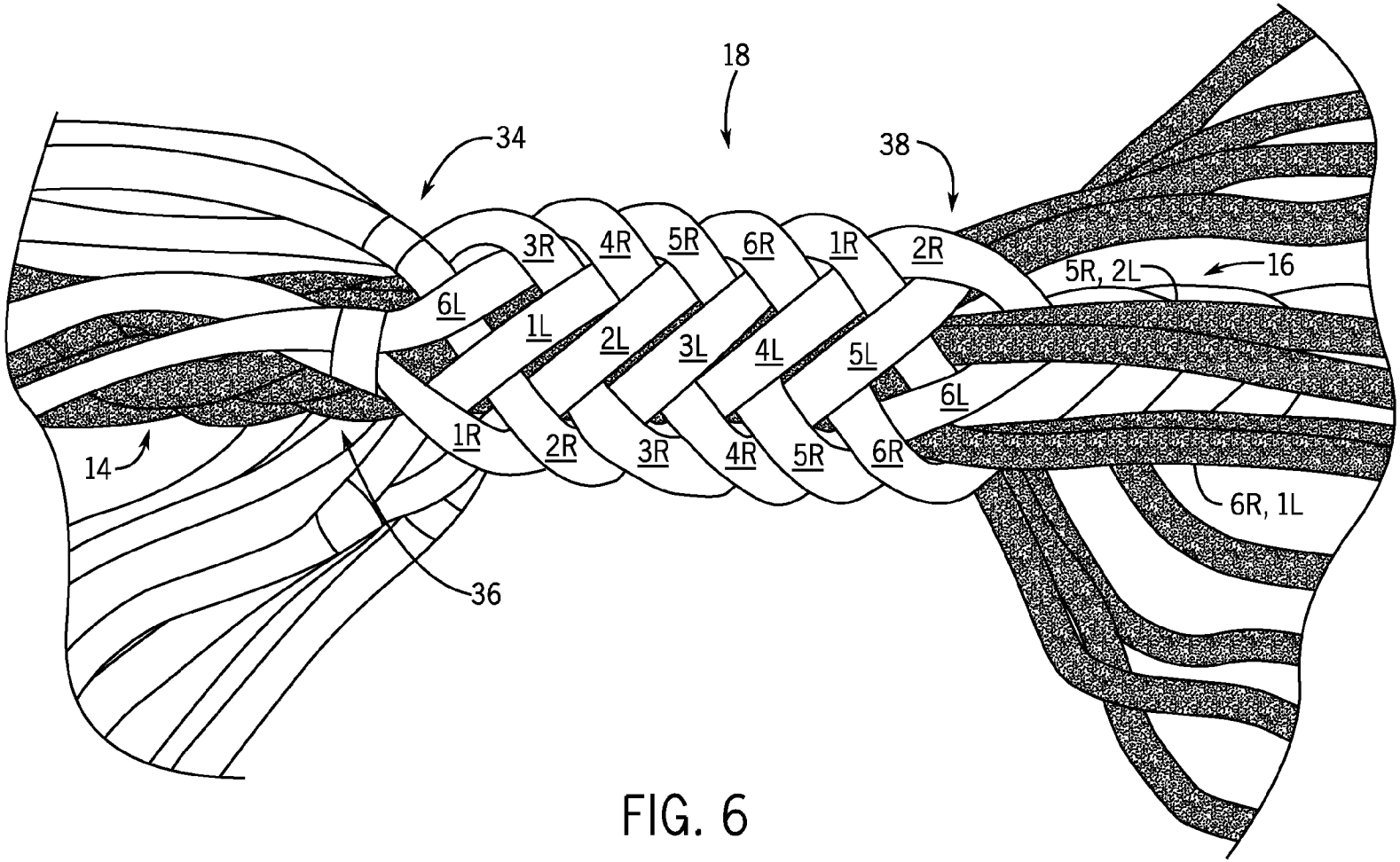
FIG. 6 is a partial side view of a step for forming a Moran section of the spliced rope apparatus.

Referring to FIG. 6, the strand pairs of the black rope 14 are next inserted into the center of the white rope 16 longitudinally at the taping location 34 to begin forming the moran section 18. That is, the strand pairs extend longitudinally through the center of the white rope 16 until they reach the exit location 38, at which point they exit the center of the white rope 16. Each strand pair of the black rope 14 passes through the exit location 38 adjacent a different intersection of the strands of the white rope 16. For example, black strand pair 5R and 2L exits the center of the white rope 16 past the intersection of white strands 1R and 5L. Generally, odd black strand pairs nR and (7−n)L for n=1, 3, and 5 exit the center of the white rope 16 past the intersection of white strands (6−n)R and nL, and even black strand pairs (7−n)R and nL for n=1, 3, and 5 exit the center of the white rope 16 past the intersection of white strands (n+5)R and (7−n)L.

To complete the moran section 18, the tape at the taping location 32 on the black rope 14 is then removed, and the black strands are pulled through the exit location 38 on the white rope 16 until the exit location 36 on the black rope 14 longitudinally aligns with the taping location 34 on the white rope 16.

After forming the moran section 18, it may be advantageous to temporarily seize the section 18 in the middle and at the ends to compress the section 18. To this end, a well-known method, such as using a double-clove hitch, may be used.

Figure 7:
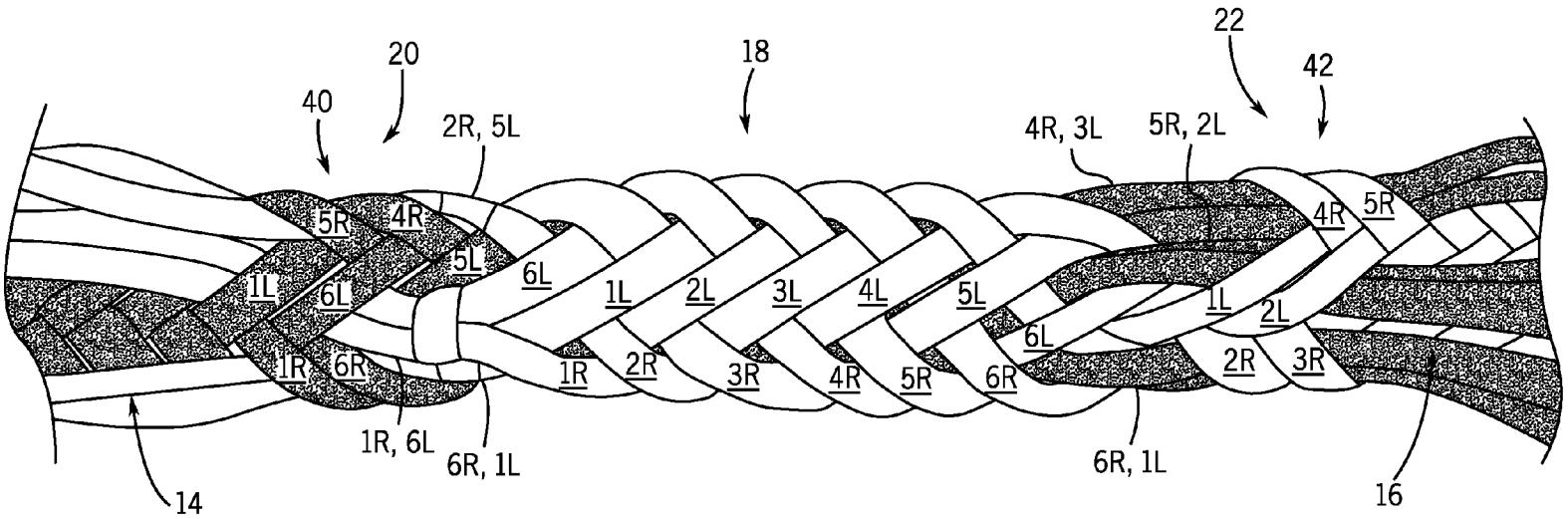
FIG. 7 is a partial side view of a step for beginning to form first and second tuck sections of the spliced rope apparatus.

Referring to FIG. 7, the strand pairs of each rope 14 and 16 are then woven with the strands of the other rope to begin forming outer portions 40 and 42 of the first and second tuck sections 20 and 22, respectively, on longitudinally opposite sides of the moran section 18. The strands of each pair together pass over one strand of the other rope 14 or 16 and then under two sequential strands of the other rope 14 or 16. For the white rope 16, for example, white strand pair 1R and 6L passes over black strand 5L and then sequentially under black strands 6L and IL. Generally, odd white strand pairs nR and (7−n)L for n=1, 3, and 5 pass over black strand (n−2)L and then sequentially under black strands (n−1)L and nL. White strand pair 2R and 5L passes over black strand 3R and then sequentially under black strands 4R and 5R. Generally, even white strand pairs (7−n)R and nL for n=1, 3, and 5 pass over black strand (n−2)R and then sequentially under black strands (n−1)R and nR.

For the black rope 14, for example, black strand pair 5R and 2L passes over white strand 6L and then sequentially under white strands 1L and 2L. Generally, odd black strand pairs nR and (7−n)L for n=1, 3, and 5 pass over white strand (n+1)L and then sequentially under white strands (n+2)L and (n+3)L. Black strand pair 4R and 3L passes over white strand 3R and then sequentially under black strands 4R and 5R. Generally, even black strand pairs (7−n)R and nL for n=1, 3, and 5 pass over white strand nR and then sequentially under white strands (n+1)R and (n+2)R.

Figure 8:
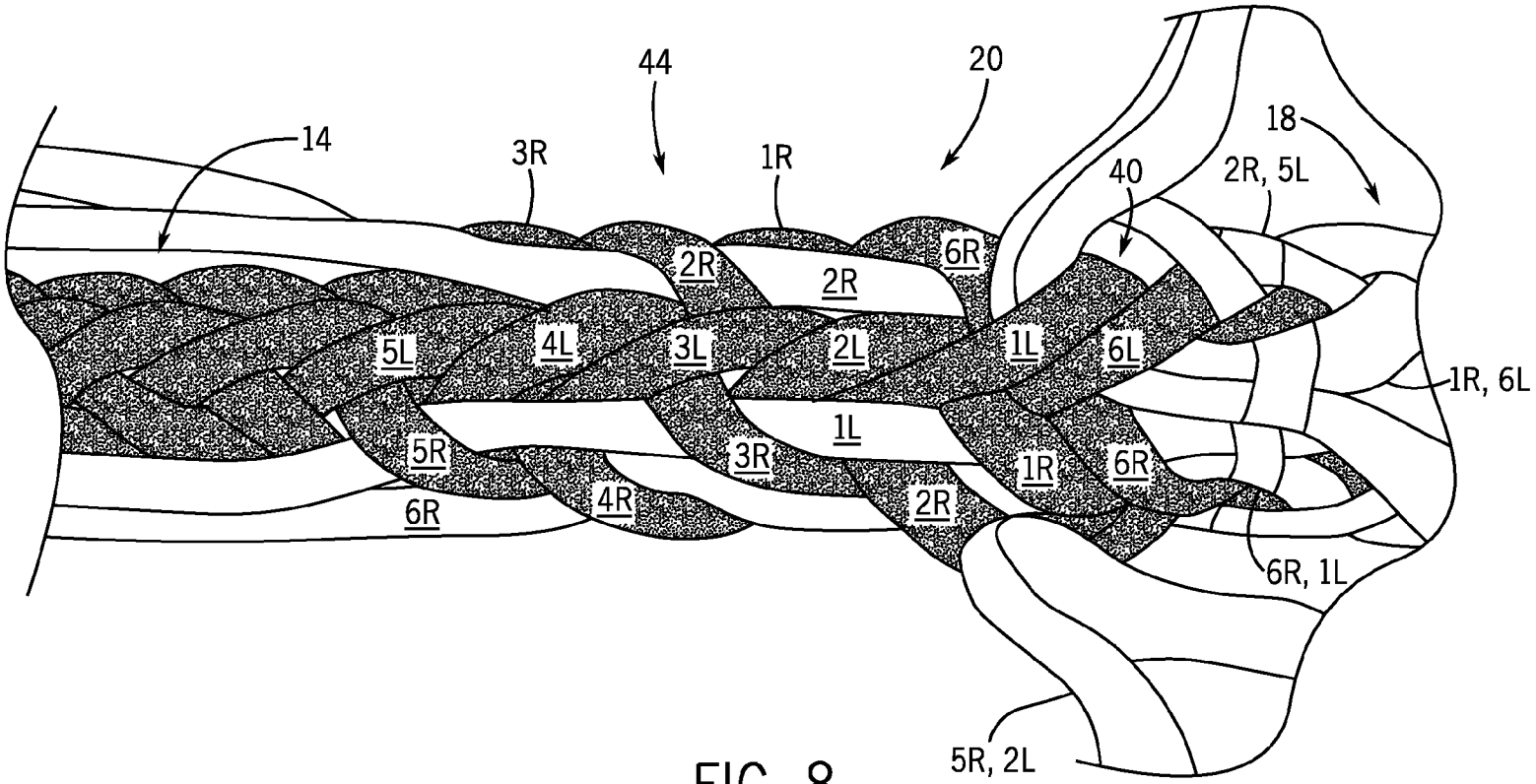
FIG. 8 is a partial side view of a step for continuing to form the first tuck section of the spliced rope apparatus.
Figure 9:
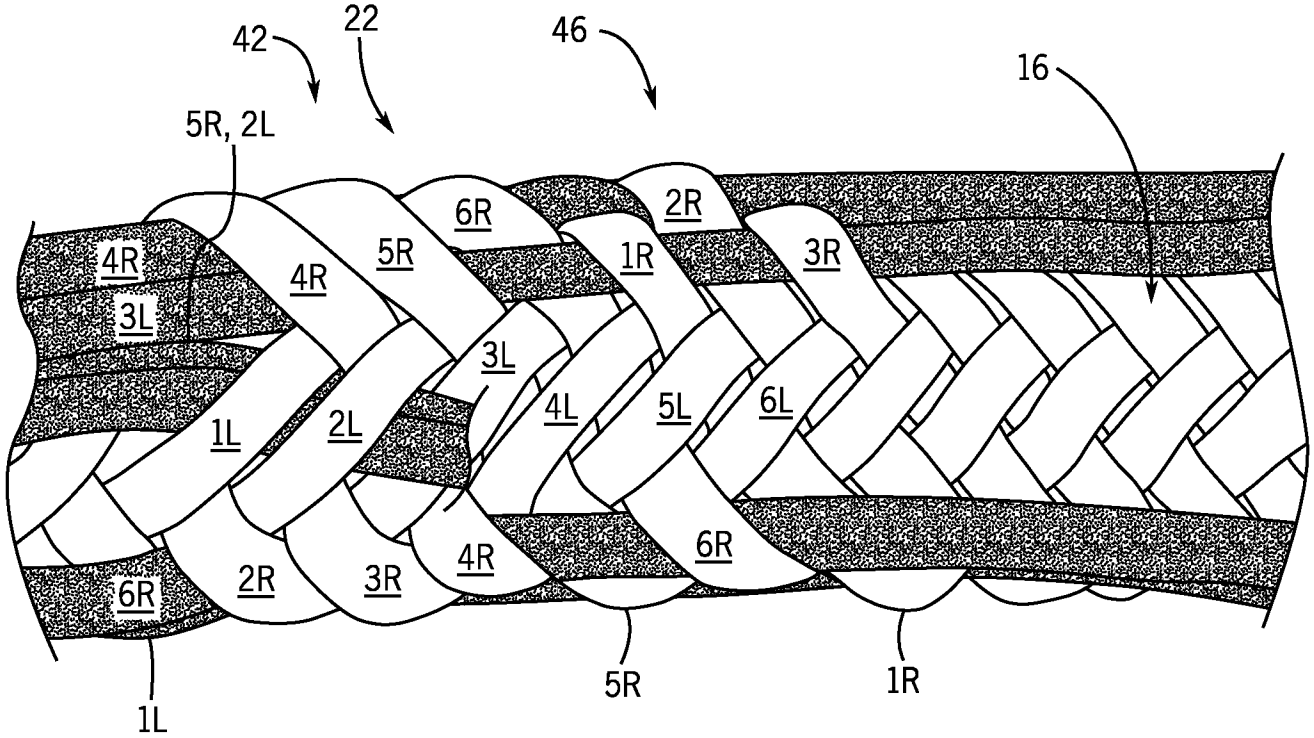
FIG. 9 is a partial side view of a step for continuing to form the second tuck section of the spliced rope apparatus.

Turning to FIGS. 8 and 9, individual strands of each rope 14 and 16 are further woven with the strands of the other rope to form inner portions 44 and 46 of the first and second tuck sections 20 and 22, respectively. In particular, the free ends of the even strand pairs (that is, (7−n)R and nL for n=1, 3, and 5) of each rope 14 and 16 are untaped, and the strands of the untaped even pairs pass sequentially, alternatingly, with respect to each other, (that is, weave with the same strands as each other but in the opposite manner), and longitudinally (that is, non-helically with respect to a sequence of picks) over and under strands of the other rope. For example and as shown in FIG. 8, untaped white strand 6R passes under black strand 2R, then over black strand 3R, then under black strand 4R, and then over black strand 5R. Alternatingly, untaped white strand 1L passes over black strand 2R, then under black strand 3R, then over black strand 4R, and then under black strand 5R. Generally, untaped white strand (7−n)R for n=1, 3, and 5 passes under black strand (n+1)R, then over black strand (n+2)R, then under black strand (n+3)R, then over black strand (n+4)R, and, alternatingly, untaped white strand nL for n=1, 3, and 5 passes over black strand (n+1)R, then under black strand (n+2)R, then over black strand (n+3)R, then under black strand (n+4)R.

As another example and as shown in FIG. 9, untaped black strand 4R passes under white strand 6R, then over white strand 1R, then under white strand 2R, and then over white strand 3R. Alternatingly, untaped black strand 3L passes over white strand 6R, then under white strand 1R, then over white strand 2R, and then under white strand 3R. Generally, untaped black strand (7−n)R for n=1, 3, and 5 passes under white strand (n+3)R, then over white strand (n+4)R, then under white strand (n+5)R, then over white strand nR, and, alternatingly, untaped black strand nL for n=1, 3, and 5 passes over white strand (n+3)R, then under white strand (n+4)R, then over white strand (n+5)R, then under white strand nR.

Figure 10:
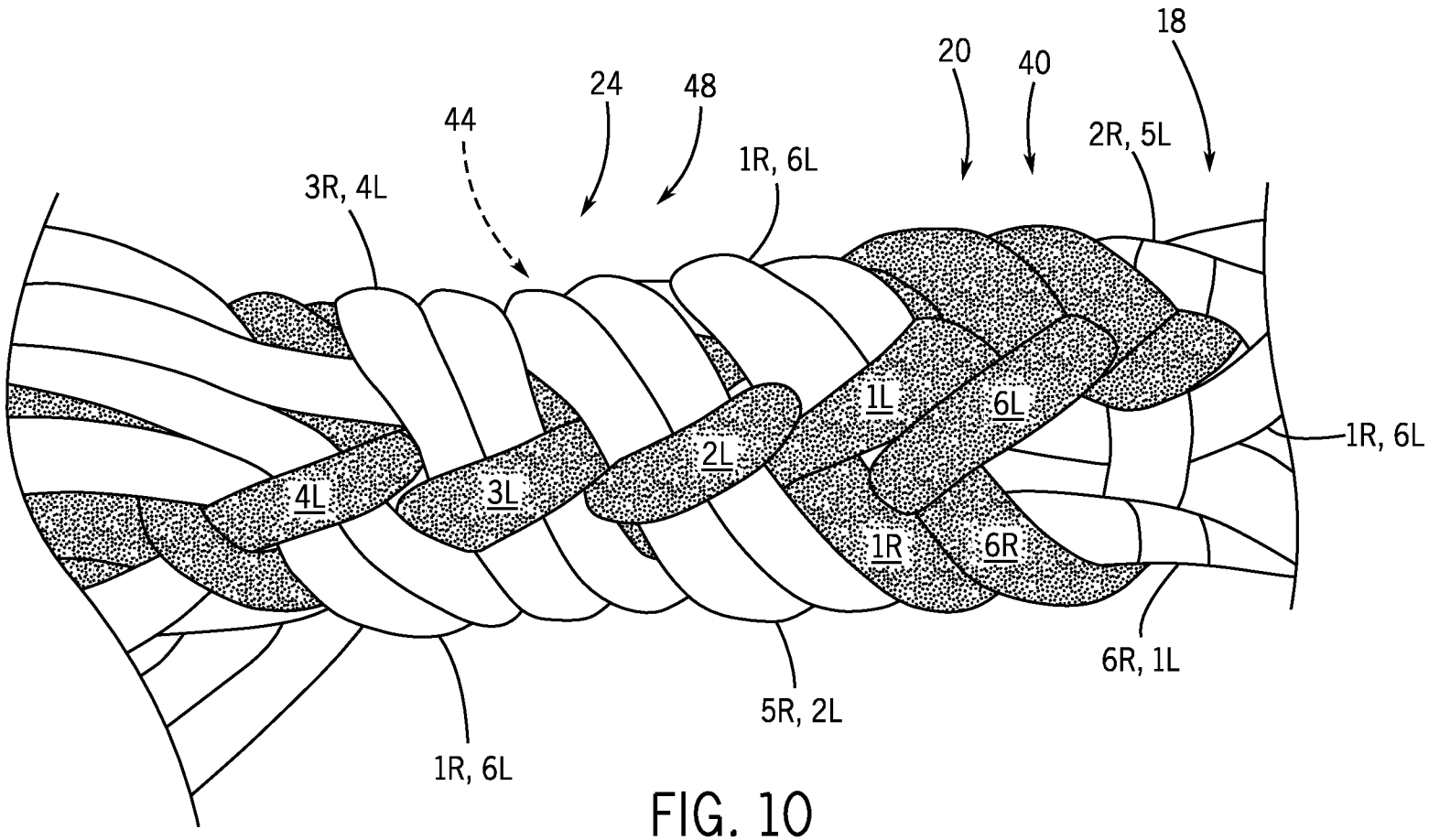
FIG. 10 is a partial side view of a step for beginning to form a first spiral section of the spliced rope apparatus.
Figure 11:
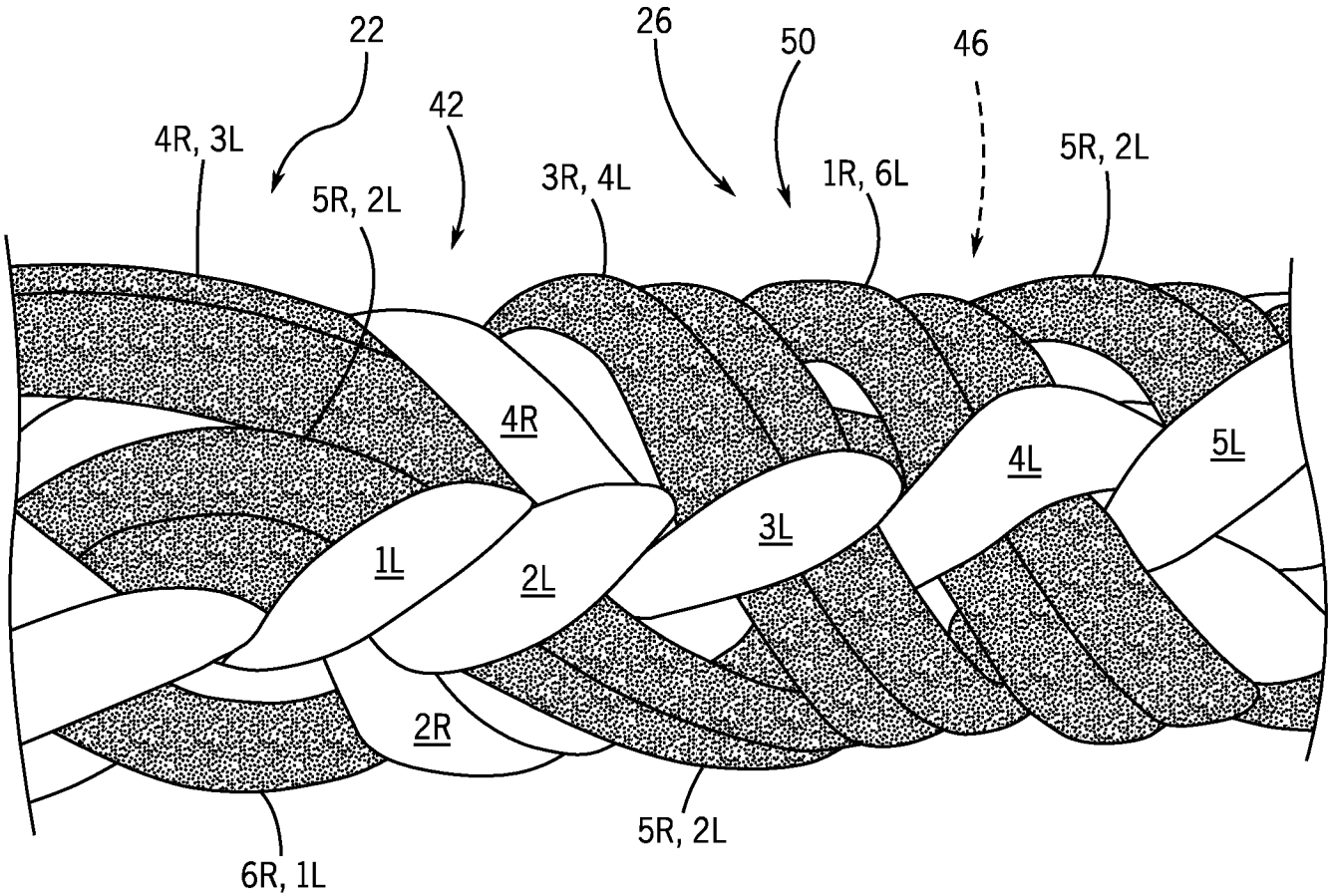
FIG. 11 is a partial side view of a step for beginning to form a second spiral section of the spliced rope apparatus.

Referring to FIGS. 10 and 11, the odd strand pairs are next woven with the strands of the other rope to form first and second right-handed portions 48 and 50 of the spiral sections 24 and 26 over the first and second inner tuck portions 44 and 46, respectively. In particular, the odd strand pairs of each rope 14 and 16 extend helically or spiral, and the strands in each odd pair together pass (that is, weave with the same strands and in the same manner as each other) under three non-sequential strands of the other rope and over the other rope and the even strand pairs between the three non-sequential strands (that is, the remainder of the strands or the previously-formed segments of the first and second tuck portions 44 and 46). For example, in the first spiral section 24 odd white strand pair 1R and 6L extends helically right-handedly and passes over a previously-formed segment of the first inner tuck portion 44, then under black strand 4L, then over a previously-formed segment of the first inner tuck portion 44, then under black strand 1L, then over a previously-formed segment of the first inner tuck portion 44, and then under black strand 4L (see FIG. 10). Generally, odd white strand pair nR and (7−n)L for n=1, 3, and 5 extends helically right-handedly around the black rope 14 and passes over a previously-formed segment of the first inner tuck portion 44, then under black strand (n+3)L, then over a previously-formed segment of the first inner tuck portion 44, then under black strand nL, then over a previously-formed segment of the first inner tuck portion 44, and then under black strand (n+3)L.

As another example, in the second right-handed spiral portion 50 odd black pair 5R and 2L extends helically right-handedly and passes over a previously-formed segment of the second inner tuck portion 46, then under white strand 5L, then over a previously-formed segment of the second inner tuck portion 46, then under white strand 2L, then over a previously-formed segment of the second inner tuck portion 46, and then under white strand 5L (see FIG. 11). Generally, odd black strand pair nR and (7−n)L for n=1, 3, and 5 extends helically right-handedly around the white rope 16 and passes over a previously-formed segment of the second inner tuck portion 46, then under white strand nL, then over a previously-formed segment of the second inner tuck portion 46, then under white strand (n+3)L, then over a previously-formed segment of the second inner tuck portion 46, and then under white strand nL.

From the above, it should be apparent that neighboring spiraling strand pairs pass under sequential picks defined by the other rope. For example and as shown in FIG. 11, odd black pair 3R and 4L passes under white strand 3L and odd black pair 1R and 6L passes under white strand 4L. It should also be apparent that the previous steps form segments of the inner tuck portions 40 and 42 with different strands than the spiral sections 24 and 26. In particular, even strand pairs weave with right-handed strands in the inner tuck portions 40 and 42, and odd strand pairs weave with left-handed strands in the spiral sections 24 and 26.

Additional segments of the tuck sections 20 and 22 and spiral sections 24 and 26 are then formed longitudinally to the side of the previously-formed segments. The weave patterns in these additional segments are similar to those described above, although the opposite strands form the tuck sections 20 and 22 and spiral sections 24 and 26.

Figure 12:
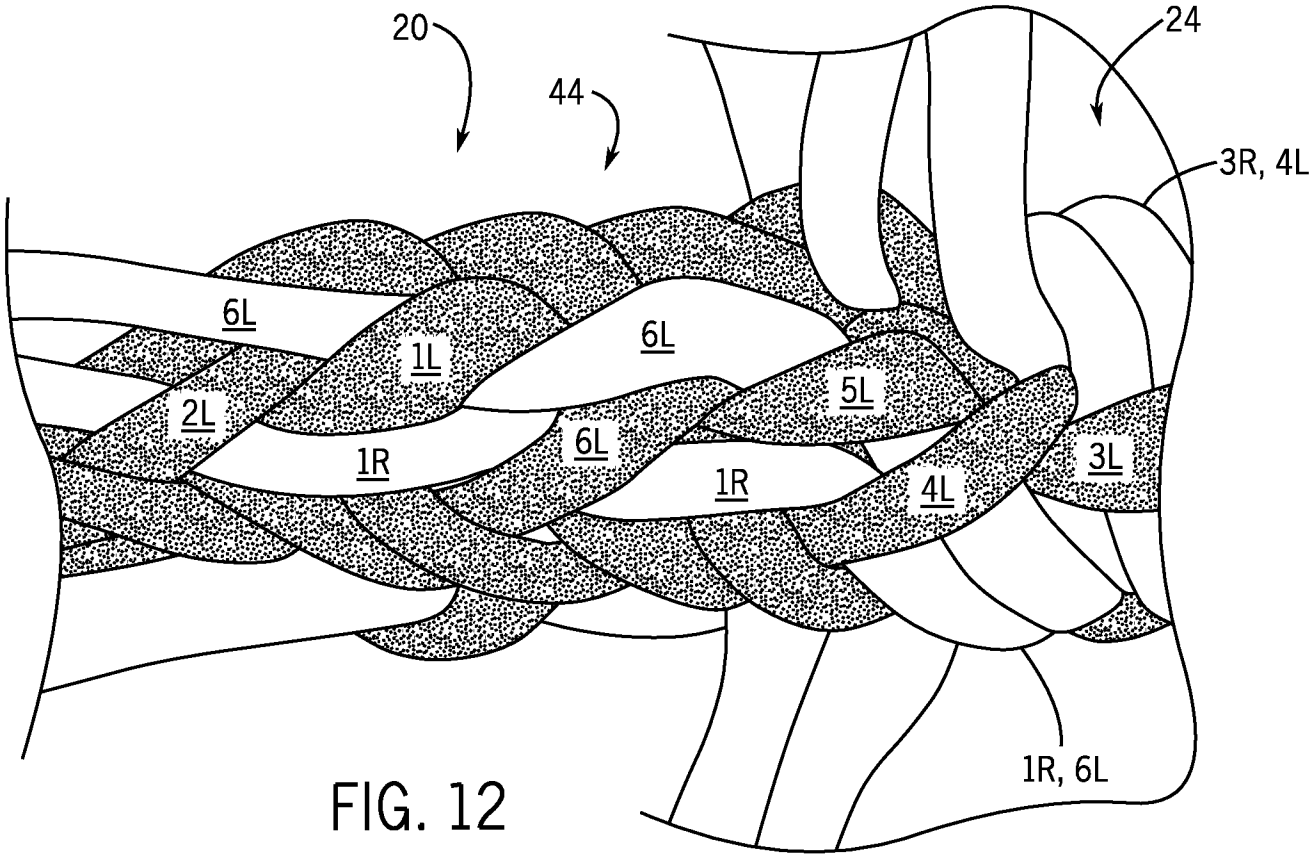
FIG. 12 is a partial side view of a step for continuing to form the first tuck section of the spliced rope apparatus.
Figure 13:
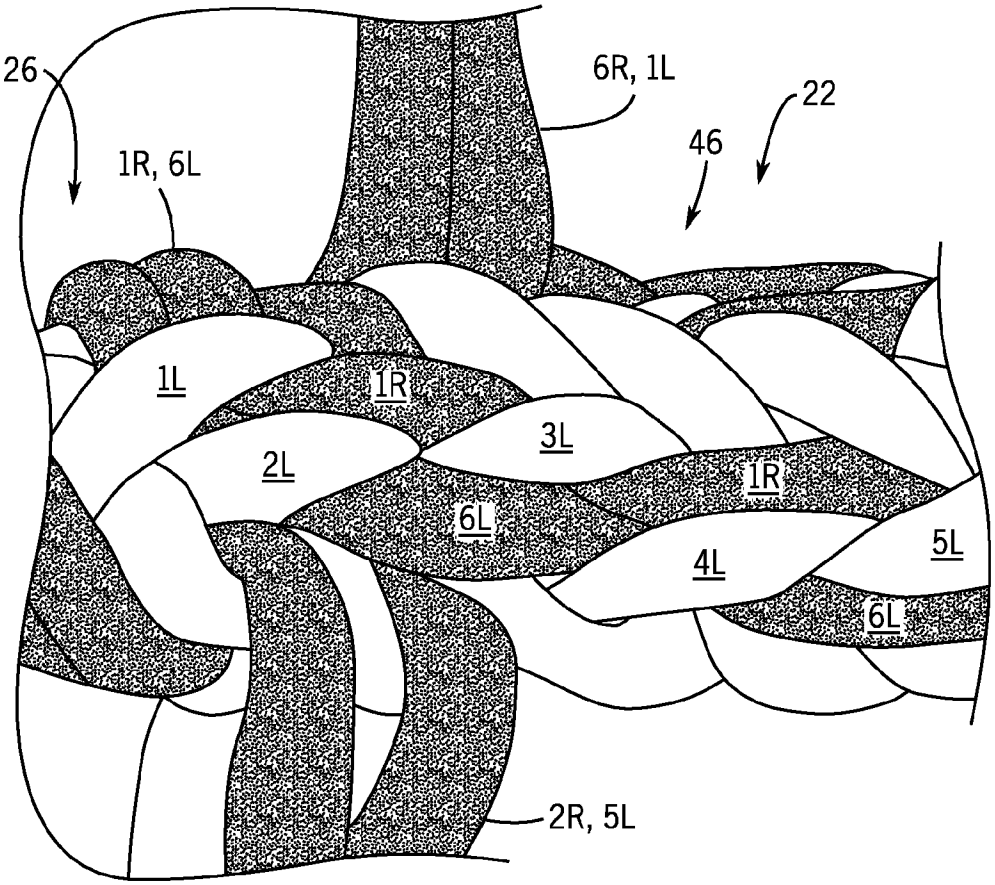
FIG. 13 is a partial side view of a step for continuing to form the second tuck section of the spliced rope apparatus.

For example and turning now to FIGS. 12 and 13, individual strands of each rope 14 and 16 are further woven with the strands of the other rope to continue forming the first and second inner tuck portions 44 and 46. In particular, the free ends of the odd strand pairs (that is, nR and (7−n)L for n=1, 3, and 5) of each rope 14 and 16 are untaped, and the strands of the untaped odd pairs sequentially, alternatingly, with respect to each other, and longitudinally pass over and under strands of the other rope. For example and as shown in FIG. 12, untaped white strand 1R passes over black strand 5L, then under black strand 6L, then over black strand 1L, and then under black strand 2L. Alternatingly, untaped white strand 6L passes under black strand 5L, then over black strand 6L, then under black strand 1L, and then over black strand 2L. Generally, untaped white strand nR for n=1, 3, and 5 passes over black strand (n+4)L, then under black strand (n+5)L, then over black strand nL, then under black strand (n+1)L, and, alternatingly, untaped white strand (7−n)L for n=1, 3, and 5 passes under black strand (n+4)L, then over black strand (n+5)L, then under black strand nL, then over black strand (n+1)L.

As another example and as shown in FIG. 13, untaped black strand 1R passes over white strand 2L, then under white strand 3L, then over white strand 4L, and then under white strand 5L. Alternatingly, untaped black strand 6L passes under white strand 2L, then over white strand 3L, then under white strand 4L, and then over white strand 5L. Generally, untaped black strand nR for n=1, 3, and 5 passes over black strand (n+1)L, then under black strand (n+2)L, then over black strand (n+3)L, then under black strand (n+4)L, and, alternatingly, untaped black strand (7−n)L for n=1, 3, and 5 passes under black strand (n+1)L, then over black strand (n+2)L, then under black strand (n+3)L, then over black strand (n+4)L.

Figure 14:
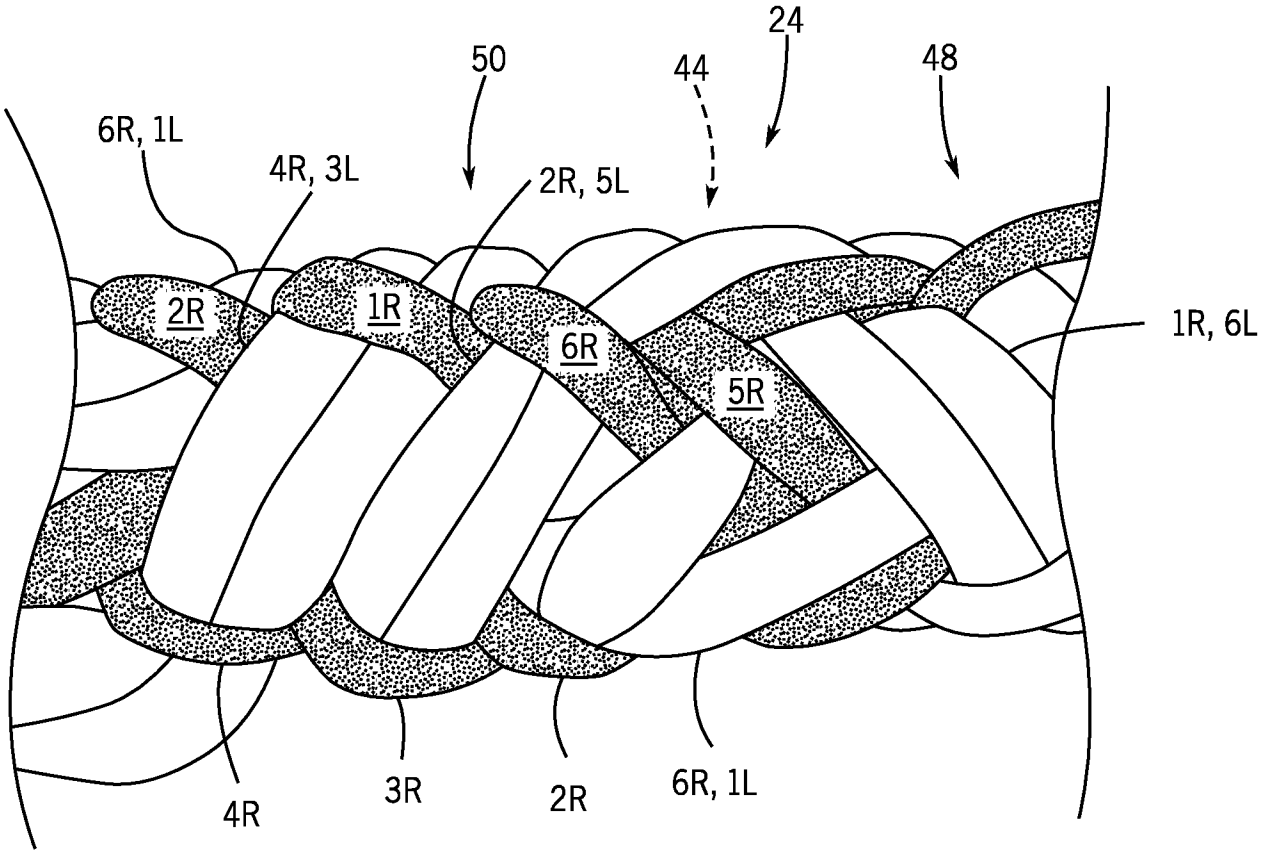
FIG. 14 is a partial side view of a step for continuing to form the first spiral section of the spliced rope apparatus.
Figure 15:
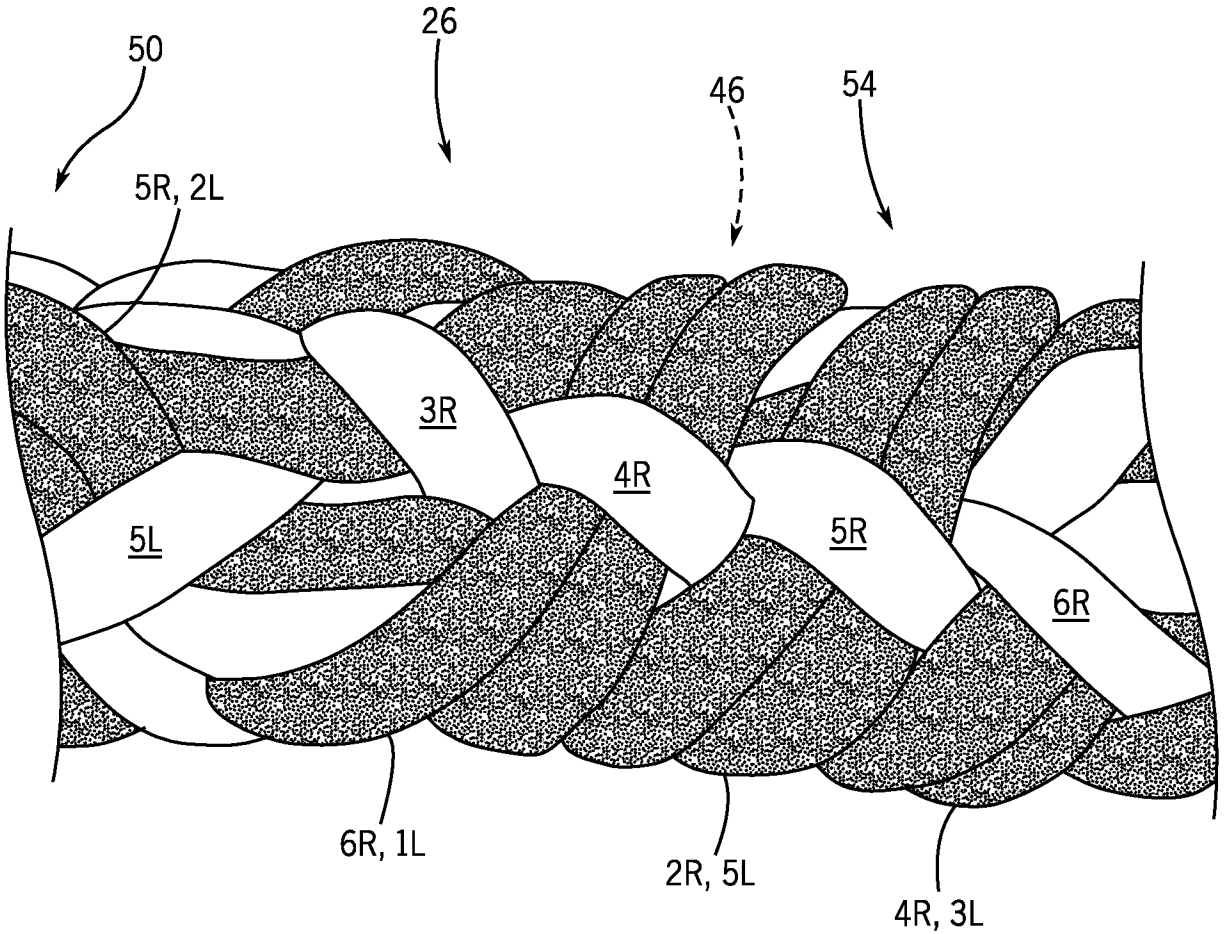
FIG. 15 is a partial side view of a step for continuing to form the second spiral section of the spliced rope apparatus.

Referring to FIGS. 14 and 15, the even strand pairs are next woven with the strands of the other rope to form first and second left-handed portions 52 and 54 of the spiral sections 24 and 26 over the first and second inner tuck portions 44 and 46, respectively. In particular, the even strand pairs of each rope 14 and 16 extend helically or spiral, and the strands in each even pair together pass under three non-sequential strands of the other rope and over the other rope and the odd strand pairs between the three non-sequential strands. For example, in the first spiral section 24 even white strand pair 6R and 1L extends helically left-handedly and passes over a previously-formed segment of the first inner tuck portion 44, then under black strand 2R (see FIG. 14), then over a previously-formed segment of the first inner tuck portion 44, then under black strand 5R, then over a previously-formed segment of the first inner tuck portion 44, and then under black strand 2R (see FIG. 14). Generally, even white strand pair (7−n)R and nL for n=1, 3, and 5 extends helically left-handedly around the black rope 14 and passes over a previously-formed segment of the first inner tuck portion 44, then under black strand (n+1)R, then over a previously-formed segment of the first inner tuck portion 44, then under black strand (n+4)R, then over a previously-formed segment of the first inner tuck portion 44, and then under black strand (n+1)R.

As another example, in the second spiral section 26 even black pair 2R and 5L extends helically left-handedly and passes over a previously-formed segment of the second inner tuck portion 46, then under white strand 2R, then over a previously-formed segment of the second inner tuck portion 46, then under white strand 5R (see FIG. 15), then over a previously-formed segment of the second inner tuck portion 46, and then under white strand 2R. Generally, even black strand pair (7−n)R and nL for n=1, 3, and 5 extends helically left-handedly around the white rope 16 and passes over a previously-formed segment of the second inner tuck portion 46, then under white strand (n+3)L, then over a previously-formed segment of the second inner tuck portion 46, then under white strand nL, then over a previously-formed segment of the second inner tuck portion 46, and then under white strand (n+3)L.

Figure 16:
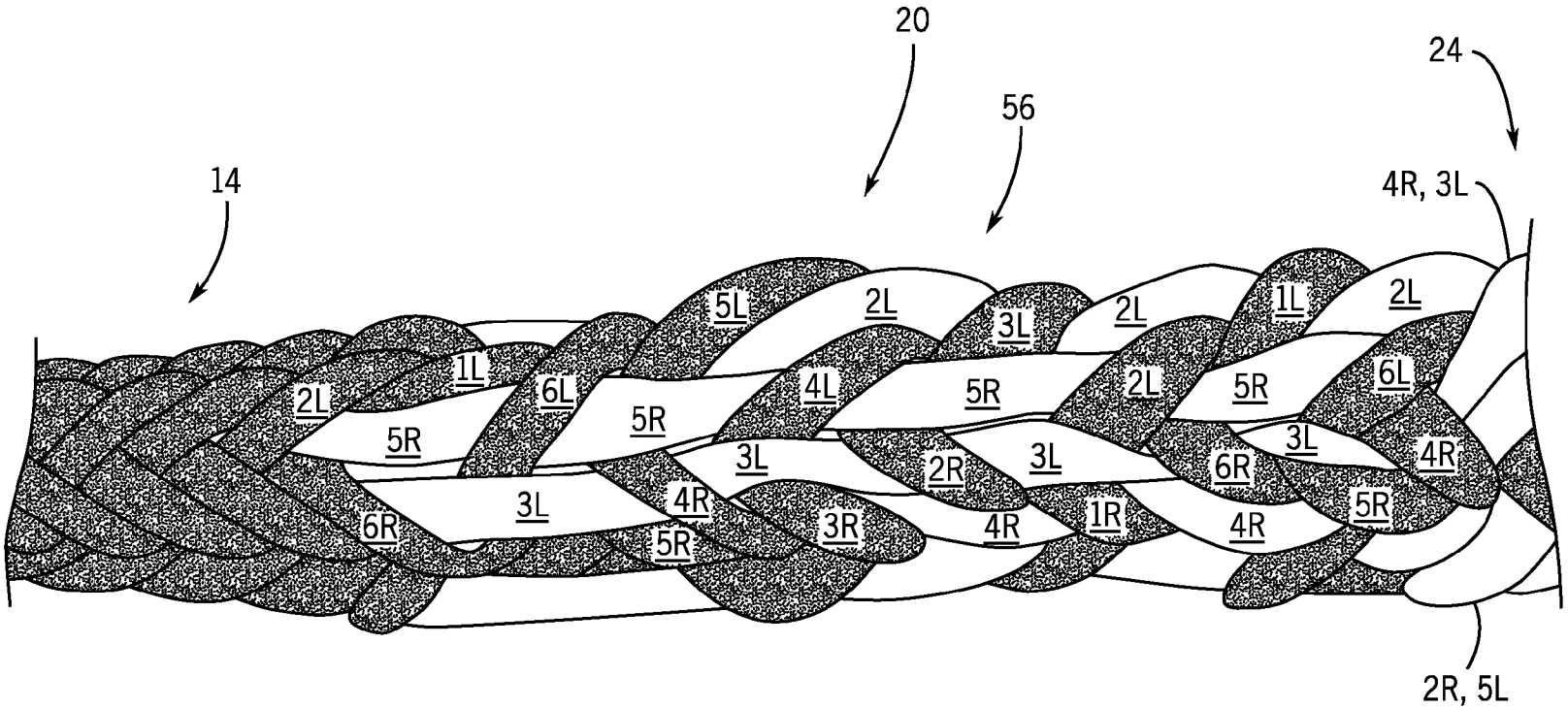
FIG. 16 is a partial side view of a step for completing the first tuck section of the spliced rope apparatus.
Figure 17:
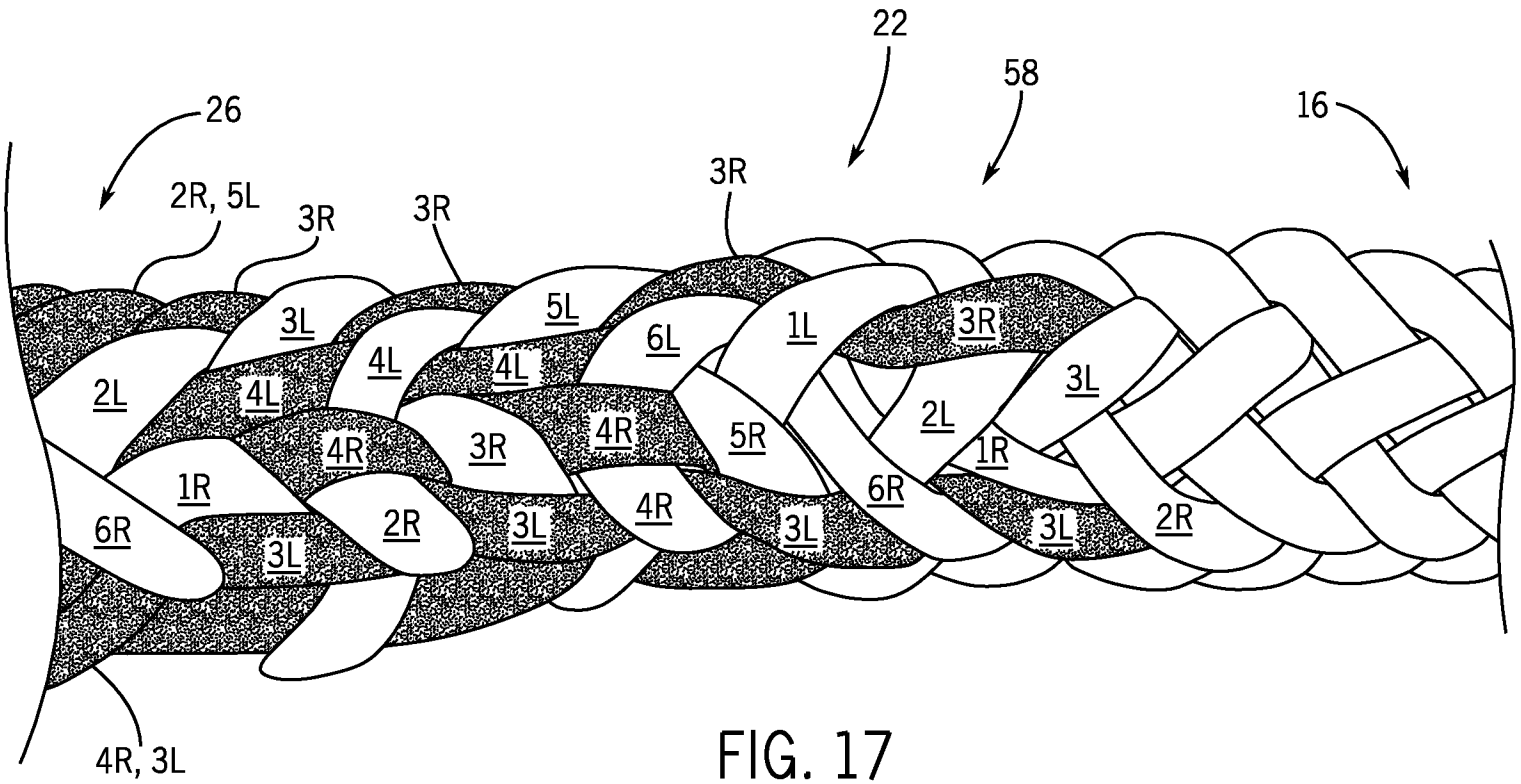
FIG. 17 is a partial side view of a step for completing the second tuck section of the spliced rope apparatus.

Turning now to FIGS. 16 and 17, the first and second tuck sections 20 and 22 are next completed by forming first and second free end burying portions 56 and 58 disposed longitudinally to the sides of the first and second spiral sections 24 and 26, respectively. Specifically, the free ends of all the strand pairs are untaped, and the strands of the untaped pairs pass sequentially, partially alternatingly, with respect to each other, and longitudinally over and under strands of the other rope before the free ends are buried within the other rope. Furthermore, the strands pass over and under several different numbers of strands of the other rope, are buried at several different positions, and extend several different distances after being buried such that the width of the splice 12 tapers to the general width of the portions of the ropes 14 and 16 longitudinally to the sides of the splice 12.

For example and as shown in FIG. 16, untaped white strand 5R passes over black strand 1L, then under black strand 2L, then over black strand 3L, then under black strand 4L, then over black strand 5L, then under black strand 6L, then over black strand 1 L, then under black strand 2L, and then is buried for a distance of fifteen picks. Partially alternatingly, untaped white strand 2L passes under black strand 1 L, then over black strand 2L, then under black strand 3L, then over black strand 4L, then under black strand 5L, and then is buried for a distance of thirteen picks. Generally, untaped white odd pair strand nR for n=1, 3, and 5 passes over black strand (n+2)L, then under black strand (n+3)L, then over black strand (n+4)L, then under black strand (n+5)L, then over black strand nL, then under black strand (n+1)L, then over black strand (n+2)L, then under black strand (n+3)L, and then is buried for a distance of (n+10) picks, and, partially alternatingly, untaped white odd pair strand (7−n)L for n=1, 3, and 5 passes under black strand (n+2)L, then over black strand (n+3)L, then under black strand (n+4)L, then over black strand (n+5)L, then under black strand nL, and then is buried for a distance of (n+8) picks.

As another example and as shown in FIG. 16, untaped white strand 4R passes under black strand 5R, then over black strand 6R, then under black strand 1R, then over black strand 2R, then under black strand 3R, and then is buried for a distance of eleven picks. Partially alternatingly, untaped white strand 3L passes over black strand 5R, then under black strand 6R, then over black strand 1R, then under black strand 2R, then over black strand 3R, then under black strand 4R, then over black strand 5R, then under black strand 6R, and then is buried for a distance of thirteen picks. Generally, untaped white even pair strand (7−n)R for n=1, 3, and 5 passes under black strand (n+2)R, then over black strand (n+3)R, then under black strand (n+4)R, then over black strand (n+5)R, then under black strand nR, and then is buried for a distance of (n+8) picks, and, partially alternatingly, untaped white even pair strand nL for n=1, 3, and 5 passes over black strand (n+2)R, then under black strand (n+3)R, then over black strand (n+4)R, then under black strand (n+5)R, then over black strand nR, then under black strand (n+1)R, then over black strand (n+2)R, then under black strand (n+3)R, and then is buried for a distance of (n+10) picks.

As another example and as shown in FIG. 17, untaped black strand 3R passes over white strand 2L, then under white strand 3L, then over white strand 4L, then under white strand 5L, then over white strand 6L, then under white strand 1L, then over white strand 2L, then under white strand 3L, and then is buried for a distance of thirteen picks. Partially alternatingly, untaped black strand 4L passes under white strand 2L, then over white strand 3L, then under white strand 4L, then over white strand 5L, then under white strand 6L, and then is buried for a distance of eleven picks. Generally, untaped black odd pair strand nR for n=1, 3, and 5 passes over white strand (n+5)L, then under white strand nL, then over white strand (n+1)L, then under white strand (n+2)L, then over white strand (n+3)L, then under white strand (n+4)L, then over white strand (n+5)L, then under white strand nL, and is buried for a distance of (n+10) picks, and, partially alternatingly, untaped black odd pair strand (7−n)L for n=1, 3, and 5 passes under white strand (n+5)L, then over white strand nL, then under white strand (n+1)L, then over white strand (n+2)L, then under white strand (n+3)L, and is buried for a distance of (n+8) picks.

As yet another example and as shown in FIG. 17, untaped black strand 4R passes under white strand 1R, then over white strand 2R, then under white strand 3R, then over white strand 4R, then under white strand 5R, and is then buried for a distance of eleven picks. Partially alternatingly, untaped black strand 3L passes over white strand 1R, then under white strand 2R, then over white strand 3R, then under white strand 4R, then over white strand 5R, then under white strand 6R, then over white strand 1R, then under white strand 2R, and then is buried for a distance of thirteen picks. Generally, untaped black even pair strand (7−n)R for n=1, 3, and 5 passes under white strand (n+4)R, then over white strand (n+5)R, then under white strand nR, then over white strand (n+1)R, then under white strand (n+2)R, and is then buried for a distance (n+8) picks, and, partially alternatingly, untaped black even pair strand nL for n=1, 3, and 5 passes over white strand (n+4)R, then under white strand (n+5)R, then over white strand nR, then under white strand (n+1)R, then over white strand (n+2)R, then under white strand (n+3)R, then over white strand (n+4)R, then under white strand (n+5)R, and then is buried for a distance of (n+10) picks.

To complete the splice 12, the free end of each strand is extracted from the other rope at the appropriate pick distance and angle cut where the strand exits the rope. The ropes 14 and 16 are then smoothed out to re-bury the angle cut free ends.

From the above description, it should be apparent that the present invention provides a spliced rope apparatus and method in which several weave patterns are used to advantageously inhibit the splice from working loose, for example, if the spliced rope apparatus repeatedly passes over a sheave. As such, as the rope wears, sections with relatively high wear can be removed and replaced with new sections instead of replacing the entire rope and sections with relatively little wear.

A preferred embodiment of the invention has been described in considerable detail. Many other modifications and variations to the preferred embodiment will be apparent to a person of ordinary skill in the art. Therefore, the invention should not be limited to the embodiment described, but should be defined by the claims that follow.

The invention claimed is:

1. A spliced rope apparatus, comprising: a first rope including a first plurality of strands; a second rope including a second plurality of strands; a splice connecting the first and second ropes and defined by the first and second pluralities of strands, the splice including: a spiral section including a first pair having strands of the first plurality of strands that are positioned proximate each other, and the first pair extending helically and the strands of the first pair together passing under a plurality of picks defined by the second plurality of strands and together passing over a remainder of the second plurality of strands; and a tuck section in which at least some of the first plurality of strands extend longitudinally to pass under and over sequential picks defined by the second plurality of strands.

2. The spliced rope apparatus of claim 1, wherein the tuck section is disposed longitudinally aside the spiral section.

3. The spliced rope apparatus of claim 2, wherein the tuck section includes a second pair having strands of the first plurality of strands that are positioned proximate each other and together sequentially pass over a first strand of the second plurality of strands and then under a second strand and a third strand of the second plurality of strands.

4. The spliced rope apparatus of claim 2, wherein the tuck section includes a second pair having strands of the first plurality of strands that are positioned proximate each other and sequentially and alternatingly, with respect to each other, pass over and under a first strand and a second strand of the second plurality of strands.

5. The spliced rope apparatus of claim 1, wherein the tuck section is disposed under the spiral section.

6. The spliced rope apparatus of claim 5, wherein the tuck section includes a second pair having strands of the first plurality of strands that are positioned proximate each other and alternatingly, with respect to each other, and sequentially pass over and under a first strand and a second strand of the second plurality of strands.

7. The spliced rope apparatus of claim 5, wherein the tuck section includes: an outer portion disposed longitudinally aside the spiral section; and an inner portion disposed below the spiral section.

8. The spliced rope apparatus of claim 7, wherein the tuck section includes a second pair having strands of the first plurality of strands that are positioned proximate each other and, in the outer portion, together sequentially pass over a first strand of the second plurality of strands, under a second strand and a third strand of the second plurality of strands, and then, in the inner portion, sequentially and alternatingly, with respect to each other, pass over and under a fourth strand and a fifth strand of the second plurality of strands.

9. The spliced rope apparatus of claim 1, wherein the first pair of strands extends helically in a right-handed direction, and wherein the spiral section includes a second pair having strands of the first plurality of strands positioned proximate each other and extending helically in a left-handed direction to together pass under another plurality of picks defined by the second plurality of strands.

10. The spliced rope apparatus of claim 1, wherein the first pair of strands extends helically in a first direction and passes under a first pick defined by the second plurality of strands, and wherein the spiral section includes a second pair having strands of the first plurality of strands positioned proximate each other and extending helically in the first direction to together pass under a second pick defined by the second plurality of strands sequential with the first pick.

11. The spliced rope apparatus of claim 1, wherein the first rope has a total of twelve strands in which six strands extend helically in a right-handed direction and six strands extend helically in a left-handed direction, and wherein the second rope has a total of twelve strands in which six strands extend helically in the right-handed direction and six strands extend helically in the left-handed direction.

12. A spliced rope apparatus, comprising: a first rope including a first plurality of strands; a second rope including a second plurality of strands; a splice connecting the first and second ropes and defined by the first and second pluralities of strands, the splice including: a spiral section including a first pair having strands of the first plurality of strands that are positioned proximate each other, and the first pair extending helically and the strands of the first pair together passing under a plurality of picks defined by the second plurality of strands and together passing over a remainder of the second plurality of strands; and a tuck section in which at least some of the first plurality of strands extend longitudinally to pass under and over sequential picks defined by the second plurality of strands;

wherein the first rope has a total of twelve strands in which six strands extend helically in a right-handed direction and six strands extend helically in a left-handed direction, and wherein the second rope has a total of twelve strands in which six strands extend helically in the right-handed direction and six strands extend helically in the left-handed direction;

wherein for both the first rope and the second rope the six strands extending helically in the right-handed direction are sequentially identifiable as nR for n=1, 2, 3, 4, 5, and 6, and the six strands extending helically in the left-handed direction are sequentially identifiable as nL for n=1, 2, 3, 4, 5, and 6, wherein strand nR forms a repeating weave pattern by passing over strands nL and (n+1)L, then under strands (n+2)L and(n+3)L, then over strands (n+4)L and (n+5)L, then under strands nL and (n+1)L, then over strands (n+2)L and (n+3)L, and then under strands (n+4)L and (n+5)L for n=1, 2, 3, 4, 5, and 6, and for a value preceding "L" that exceeds six, six is subtracted from the value.

13. The spliced rope apparatus of claim 12, wherein the spiral section includes three pairs of strands of the first plurality of strands given by nR and (7−n)L for n=1, 3, and 5, and the strands in each of the three pairs are positioned proximate each other and extend helically in the right-handed direction to together pass under the plurality of picks defined by the second plurality of strands and together pass over the remainder of the second plurality of strands.

14. The spliced rope apparatus of claim 13, wherein the three pairs of strands of the first plurality of strands given by nR and (7−n)L for n=1, 3, and 5 each extend helically in the right-handed direction and the strands nR and (7−n)L together pass under strand (n+3)L of the second plurality of strands, under strand nL of the second plurality of strands, and under strand (n+3)L of the second plurality of strands, and for a value preceding "L" that exceeds six, six is subtracted from the value.

15. The spliced rope apparatus of claim 13, wherein the spiral section includes a right-handed portion defined by the three pairs of strands of the first plurality of strands; a left-handed portion disposed longitudinally aside from the right-handed portion, the left-handed portion including three additional pairs of strands of the first plurality of strands given by (7−n)R and nL for n=1, 3, and 5, and the strands in each of the three additional pairs are positioned proximate each other and extend helically in the left-handed direction to together pass under another plurality of picks defined by the second plurality of strands and together pass over another remainder of the second plurality of strands.

16. The spliced rope apparatus of claim 13, wherein the tuck section is disposed below the spiral section, and in the tuck section strands of the first plurality of strands given by (7−n)R for n=1, 3, and 5 pass under strand (n+1)R of the second plurality of strands, then over strand (n+2)R of the second plurality of strands, then under strand (n+3)R of the second plurality of strands, then over strand (n+4)R of the second plurality of strands, and strands of the first plurality of strands given by nL for n=1, 3, and 5 pass over strand (n+1)R of the second plurality of strands, then under strand (n+2)R of the second plurality of strands, then over strand (n+3)R of the second plurality of strands, then under strand (n+4)R of the second plurality of strands, and for a value preceding "R" that exceeds six, six is subtracted from the value.

17. A method of splicing a first rope including a first plurality of strands to a second rope including a second plurality of strands, the method comprising the steps of: forming a spiral splice section by helically extending a first pair of strands of the first plurality of strands around the second rope, passing the strands of the first pair together under a plurality of picks defined by the second plurality of strands, and passing the strands of the first pair together over a remainder of the second plurality of strands; and forming a tuck splice section by alternatingly and longitudinally passing at least some of the first plurality of strands under and over sequential picks defined by the second plurality of strands.

18. The method of claim 17, wherein the step of forming the tuck splice section includes forming the tuck splice section longitudinally to at least one side of the spiral splice section.

19. The method claim 18, wherein the step of forming the tuck splice section further includes forming the tuck splice section below the spiral splice section by alternatingly and longitudinally passing the at least some of the first plurality of strands under and over the sequential picks defined by the second plurality of strands before forming the spiral splice section.

20. The method of claim 17, wherein the step of forming the tuck splice section includes forming the tuck splice section below the spiral splice section by alternatingly and longitudinally passing the at least some of the first plurality of strands under and over the sequential picks defined by the second plurality of strands before forming the spiral splice section.

* * * * *